US012372241B2

(12) United States Patent
Weilert et al.

(10) Patent No.: US 12,372,241 B2
(45) Date of Patent: Jul. 29, 2025

(54) SURROUND FOR A FIRE PIT

(71) Applicant: Solo Brands, LLC, Grapevine, TX (US)

(72) Inventors: Jeffrey R. Weilert, Southlake, TX (US); Alexander K. Maghsadi, Lewisville, TX (US)

(73) Assignee: Solo Brands, LLC, Grapevine, TX (US)

( * ) Notice: Subject to any disclaimer, the term of this patent is extended or adjusted under 35 U.S.C. 154(b) by 393 days.

(21) Appl. No.: 17/810,964

(22) Filed: Jul. 6, 2022

(65) Prior Publication Data

US 2024/0011639 A1 Jan. 11, 2024

(51) Int. Cl.
*F24B 1/19* (2006.01)
*F24B 1/181* (2006.01)
*F24B 1/195* (2006.01)

(52) U.S. Cl.
CPC ..... *F24B 1/195* (2013.01); *F24B 1/181* (2013.01)

(58) Field of Classification Search
CPC ..... F24B 1/195; F24B 1/181; F24B 13/002
See application file for complete search history.

(56) References Cited

U.S. PATENT DOCUMENTS 9,138,099 B2 9/2015 Dhuper
9,474,415 B2 10/2016 Banal
10,107,502 B2 10/2018 Mueller
2012/0222668 A1* 9/2012 Unger ..... F24C 3/022 126/544
2015/0068512 A1 3/2015 Mehler
2016/0166109 A1* 6/2016 Banal ..... A47B 11/00 108/50.13
2019/0159630 A1 5/2019 Salum
2020/0096199 A1 3/2020 Harrington
2021/0180792 A1* 6/2021 Kovar ..... F24B 1/192
2021/0321821 A1* 10/2021 Stoltzfus ..... F24B 1/182
2022/0252274 A1 8/2022 Zemel

FOREIGN PATENT DOCUMENTS

CN 215982730 U 3/2022

OTHER PUBLICATIONS

Korean Intellectual Property Office, International Search Report and Written Opinion of the International Searching Authority, International Application No. PCT/US2023/069058, mailed Oct. 17, 2023, 10 pages.
[Facebook image]. Facebook. Retrieved Jun. 24, 2022, from https://m.facebook.com/photo.php?fbid=10111207675789838&id=16704020&set=gm.958565794864672&source=48F.

* cited by examiner

*Primary Examiner* — Alfred Basichas
(74) *Attorney, Agent, or Firm* — Haynes and Boone, LLP

(57) ABSTRACT

A surround for a fire pit is provided. The surround includes a frame with at least three legs, each leg having a connector on top. The surround also includes a number of tabletop sections, each configured to connect to the respective connectors of at least two of the legs, and also configured to quick disconnect from the connectors. The surround also includes a number of bezel sections, each extending radially inward from the inward facing side of a tabletop section. The inner edges of the bezel sections collectively define an inner perimeter of the surround.

20 Claims, 12 Drawing Sheets

SURROUND FOR A FIRE PIT

TECHNICAL FIELD

The subject matter described herein relates to a surround for a fire pit. This surround has particular but not exclusive utility for portable fire pits.

BACKGROUND

Portable fire pits are commonly used in back yards for recreation, camping, and other locations to provide outdoor heat and to support over-fire cooking including marshmallow roasting.

A fireplace surround is an architectural element which surrounds a fireplace, providing aesthetic and utility benefits. Although architectural elements are commonly found in built-in fireplaces, it appears that there are not such elements for a portable fire pit. In addition, fire pits can generate significant heat, such that outer surfaces of the fire pit may become hot. This presents a risk of heat damage to surfaces on which the fire pit is placed (e.g., grass, asphalt, concrete, etc.), and risk to humans and animals that come in direct contact with the fire pit.

Accordingly, a fire pit surround could provide advantages relating to utility purposes, aesthetic purposes, reducing exposure to hot surfaces on which the fire pit is placed, and/or other purposes.

The information included in this Background section of the specification, including any references cited herein and any description or discussion thereof, is included for technical reference purposes only and is not to be regarded as subject matter by which the scope of the disclosure is to be bound.

SUMMARY

The present disclosure provides a surround structure that partially encloses a fire pit, thus protecting the ground from direct contact with the bottom surface of the fire pit structure, and protecting humans and animals from direct contact with outer surfaces of the fire pit. The fire pit surround includes support legs, support hoops, and fabric panels that establish a perimeter separated from the fire pit's outer surfaces by a safety gap. The fire pit surround can also include tabletop portions on which food, drinks, eating utensils, and other items may be placed, as well as vented bezel portions to offset the tabletop portions from the outer surfaces of the fire pit. The fire pit surround is configured such that a user can remove (for example) one tabletop portion, one bezel portion, and one fabric panel with attached support hoop segments, to create an opening in the fire pit surround that facilitates access to the fire pit.

The fire pit and surround system disclosed herein has particular, but not exclusive, utility for portable back yard fire pits. One general aspect includes a surround for a fire pit. The surround includes a frame including: at least three legs, each leg of the at least three legs including a connector disposed at a top portion. The surround also includes a plurality of tabletop sections, each tabletop section having lateral ends, an inward facing side, and an outward facing side and being configured to connect to the respective connectors of at least two of the legs and also configured to quick disconnect from the connector of said at least two of the legs. The surround also includes a plurality of bezel sections, each bezel section of the plurality of bezel sections extending radially inward from the inward facing side of a tabletop section of the plurality of tabletop sections, each bezel section having lateral ends, an inner edge, and an outer edge, the inner edge of the plurality of bezel sections defining an inner perimeter of the surround.

Implementations may include one or more of the following features. In some embodiments, the frame further includes: at least two support hoops removably attached to at least two of the legs; and a plurality of panels removably attached to the at least two support hoops. In some embodiments, at least one tabletop section, at least one bezel section, at least one leg, or at least one panel includes an added color, pattern, image, or logo. In some embodiments, each bezel section removably extends from least one of the tabletop sections. In some embodiments, the surround further includes a fire pit support including a plurality of support arms extending radially inward from the at least three legs to a central intersection. In some embodiments, the inner edge of the plurality of bezel sections form an entirely enclosed inner perimeter of the surround.

One general aspect includes a surround for a fire pit. The surround includes a frame including: at least three legs, each leg of the at least three legs including a cradle disposed at a top portion of the leg; and at least two support hoops removably attachable to at least two of the legs. The surround also includes a panel removably attached to the at least two support hoops. The surround also includes a plurality of tabletop sections, each tabletop section configured to rest removably in the cradles of at least two of the legs. The surround also includes a plurality of bezel sections removably connectable to and extending radially inward from the tabletop sections, each bezel section of the plurality of bezel sections including an inner edge and an outer edge, the inner edge defining an inner perimeter of the surround.

Implementations may include one or more of the following features. In some embodiments, the surround further including a fire pit support including a plurality of support arms extending radially inward from the at least three legs to a central intersection. In some embodiments, each support hoop includes removable hoop sections, each hoop section including part of a circumference of the support hoop. In some embodiments, the surround is configured such that a radial section of the surround, defined by a central axis of the surround and two of the legs, can be opened by removing removable hoop sections, a panel, a tabletop section, and a bezel section from within the radial section. In some embodiments, at least some of the tabletop sections, at least some of the bezels sections or at least some of the panels are held in place by one or more removable fasteners. In some embodiments, at least one tabletop section, at least one bezel section, at least one leg, or at least one panel includes an added color, pattern, image, or logo.

One general aspect includes a surround for a fire pit. The surround includes a frame including: at least three legs, each leg of the at least three legs including a connector disposed at a top portion; a fire pit support including a plurality of support arms extending radially inward from the at least three legs to a central intersection. The surround also includes a plurality of tabletop sections, each tabletop section having lateral ends, an inward facing side, and an outward facing side and being configured to connect to the connector of at least two of the legs and also configured to quick disconnect from the connector of said at least two of the legs to provide access to the fire pit support.

Implementations may include one or more of the following features. Some embodiments further include a plurality of bezel sections, each bezel section extending radially inward from the inward facing side of a tabletop section, each bezel section of the plurality of bezel sections having lateral ends, an inner edge, and an outer edge, the inner edge of the plurality of bezel sections defining an inner perimeter of the surround. In some embodiments, each bezel section removably extends from least one of the tabletop sections. In some embodiments, the inner edge of the plurality of bezel sections form an entirely enclosed inner perimeter of the surround. In some embodiments, the frame further includes: at least two support hoops removably attached to at least two of the legs; and a plurality of panels removably attached to the at least two support hoops. In some embodiments, at least one tabletop section, at least one bezel section, at least one leg, or at least one panel includes an added color, pattern, image, or logo. In some embodiments, each support hoop includes removable hoop sections, each hoop section including part of a circumference of the support hoop. In some embodiments, the surround is configured such that a radial section of the surround, defined by a central axis of the surround and two of the legs, can be opened by removing removable hoop sections, a panel, a tabletop section, and a bezel section from within the radial section.

This Summary is provided to introduce a selection of concepts in a simplified form that are further described below in the Detailed Description. This Summary is not intended to identify key features or essential features of the claimed subject matter, nor is it intended to limit the scope of the claimed subject matter. A more extensive presentation of features, details, utilities, and advantages of the fire pit surround, as defined in the claims, is provided in the following written description of various embodiments of the disclosure and illustrated in the accompanying drawings.

BRIEF DESCRIPTION OF THE DRAWINGS

Illustrative embodiments of the present disclosure will be described with reference to the accompanying drawings, of which.

DETAILED DESCRIPTION

Figure 1:
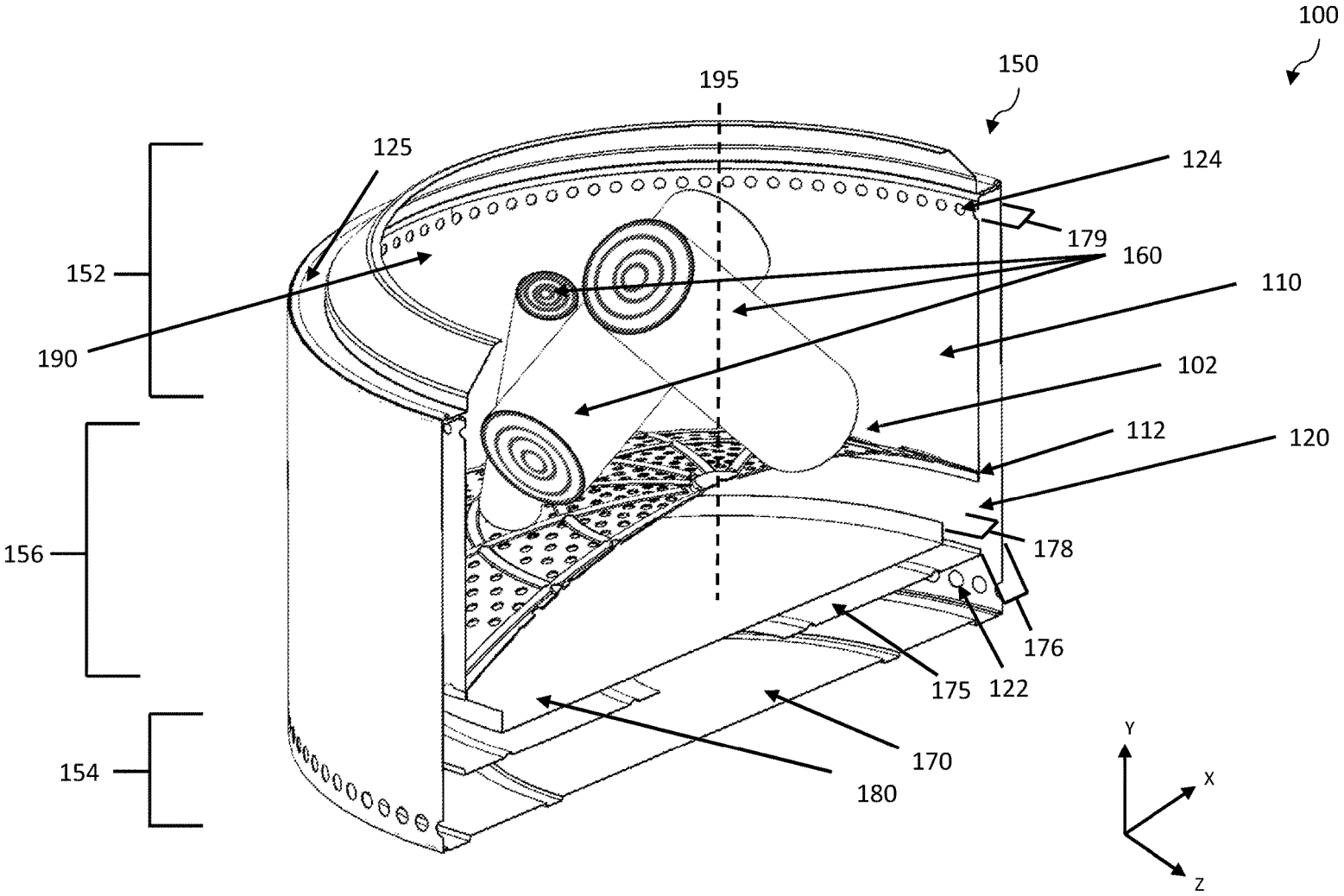
FIG. 1 is a perspective, cross-sectional view of an example combustion stove, such as a wood burning stove or fire pit that can be placed within a fire pit surround and that can thus be part of a fire pit and surround system, in accordance with at least one embodiment of the present disclosure.

The present disclosure is directed to a surround for a fire pit and directed to fire pit and surround systems. The surround at least partially encloses the fire pit. In some examples, it may elevate the fire pit preventing direct contact with the ground, and may shield sides of the fire pit from undesired direct access. In some examples, the fire pit surround may include support legs, support hoops, and panels that establish a perimeter separated from the fire pit's outer surfaces by a gap. The panels may also serve an aesthetic function. In some embodiments, the fire pit surround also includes tabletop portions upon which a user may place items, and also includes bezel portions to help center and to offset the tabletop portions from the outer surfaces of the fire pit.

In some embodiments, the tabletop portions, bezel portions, support hoop segments, and panels may be easily removable from other features of the surround. This may, for example, allow a user to create an opening in the fire pit surround that facilitates access to the fire pit. Such access may for example be useful for loading, lighting, emptying, or cleaning of the fire pit, or for other reasons.

For the purposes of promoting an understanding of the principles of the present disclosure, reference will now be made to the embodiments illustrated in the drawings, and specific language will be used to describe the same. It is nevertheless understood that no limitation to the scope of the disclosure is intended. Any alterations and further modifications to the described devices, systems, and methods, and any further application of the principles of the present disclosure are fully contemplated and included within the present disclosure as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately.

FIG. 1 is a perspective, cross-sectional view of an example combustion stove, such as a wood burning stove or fire pit 150 that can be placed within a fire pit surround, which is described herein.

In the example embodiment of FIG. 1, the combustion stove or fire pit 150 includes a top portion 152, a bottom portion 154, and a middle portion 156. The fire pit 150 further includes an inner wall or inner body 110, an outer wall or outer body 120, a connecting ring 125 located in the top portion 152 of the stove or fire pit 150 and attached to or formed as a single piece with the inner body 110 and the outer body 120, and a combustion cavity 190 defined by the inner body 110, within which a fire grate 102 is positioned. The fire grate 102 supports the weight of fuel 160 (e.g., wooden logs and sticks) while permitting air flow through the fire grate 102 and stove or fire pit 150 to facilitate combustion of the fuel 160.

The stove or fire pit 150 further includes a top lip 115 attached to or formed as a single piece with either of the inner body 110 and outer body 120. The stove or fire pit 150 further includes a plurality of outer ventilation holes 122 located in the bottom portion 154 of the outer body 120, and a plurality of inner ventilation holes 124 located in the top portion 152 of the inner body 110. In the middle portion 156 of the stove or fire pit 150, the inner body 110 terminates in an upward-facing support lip or rollover 112 into which the fire grate 102 fits, or upon which the fire grate 102 rests.

The stove or fire pit 150 further includes a base plate 170 attached to the outer body 120, a bracing tray 175 supported by stands projecting upward from the base plate, and a catch tray 180 supported by stands projecting upward from the bracing tray 175 such that the bracing tray is separated from the outer body by an air gap 176, the catch tray 180 is separated from the outer body 120 by an air gap 178, and the inner body is separated from the outer body by an air gap 179. In an example, air gaps 176 and 179 are both about 50 mm, while air gap 178 is about 100 mm, although other air gaps may be employed that have the disclosed, advantageous effect.

In some examples, the cavity 190 is in fluid communication with the air gap 179 via the inner ventilation holes 124, and with air gaps 178 and 176 via the fire pit surround 200. The air gaps 176 and 178 are in fluid communication with ambient air via the outer ventilation holes 122, such that ambient air may be drawn in through the outer ventilation holes 122, heated by combustion of the fuel 160, and expelled through the cavity 190 and inner ventilation holes 124 to produce advantageous combustion of the fuel 160. In the example shown in FIG. 1, the fire pit 150 is circular around a central axis 195.

Figure 2:
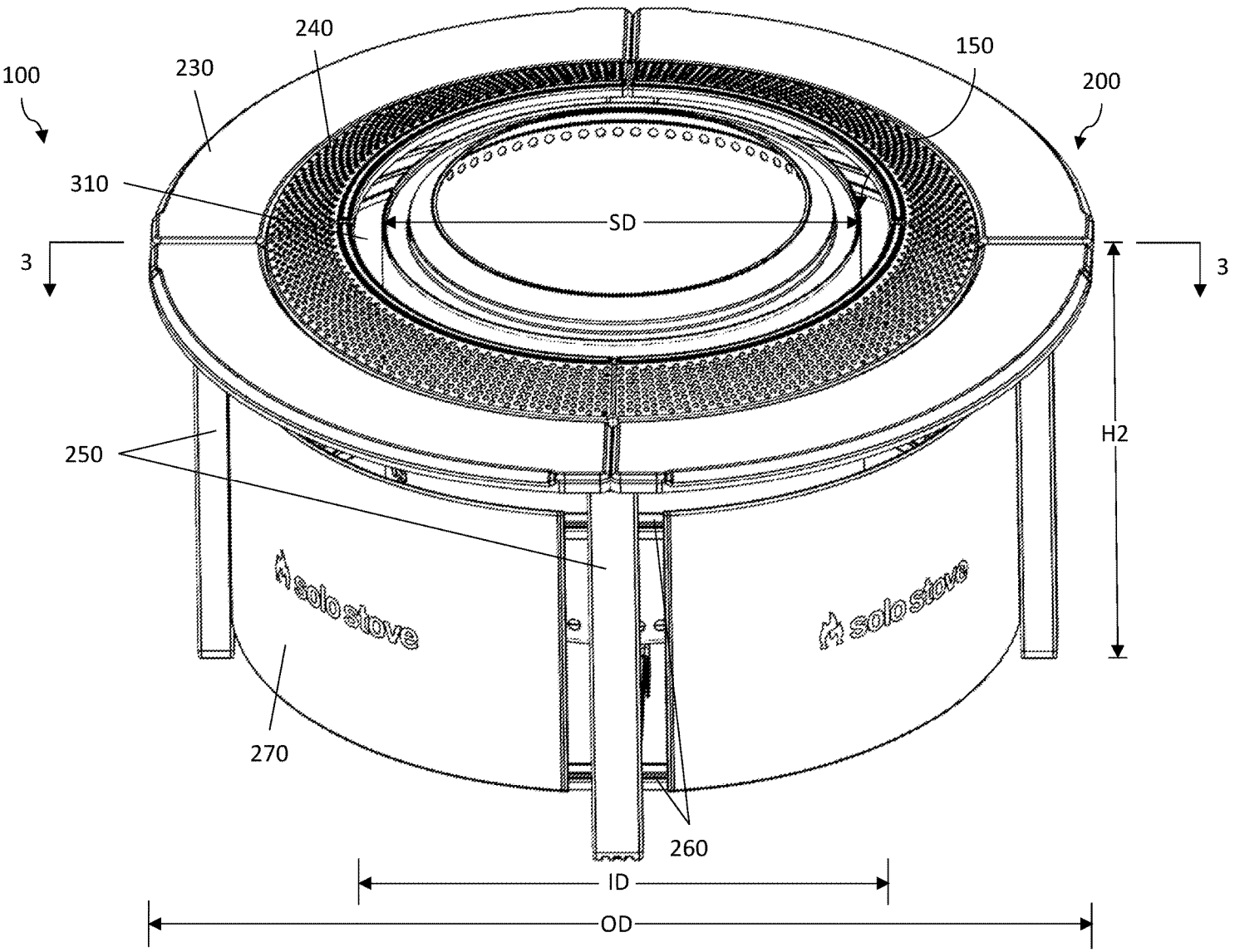
FIG. 2 is a top front perspective view of an example fire pit and surround system, in accordance with at least one embodiment of the present disclosure.
Figure 3:
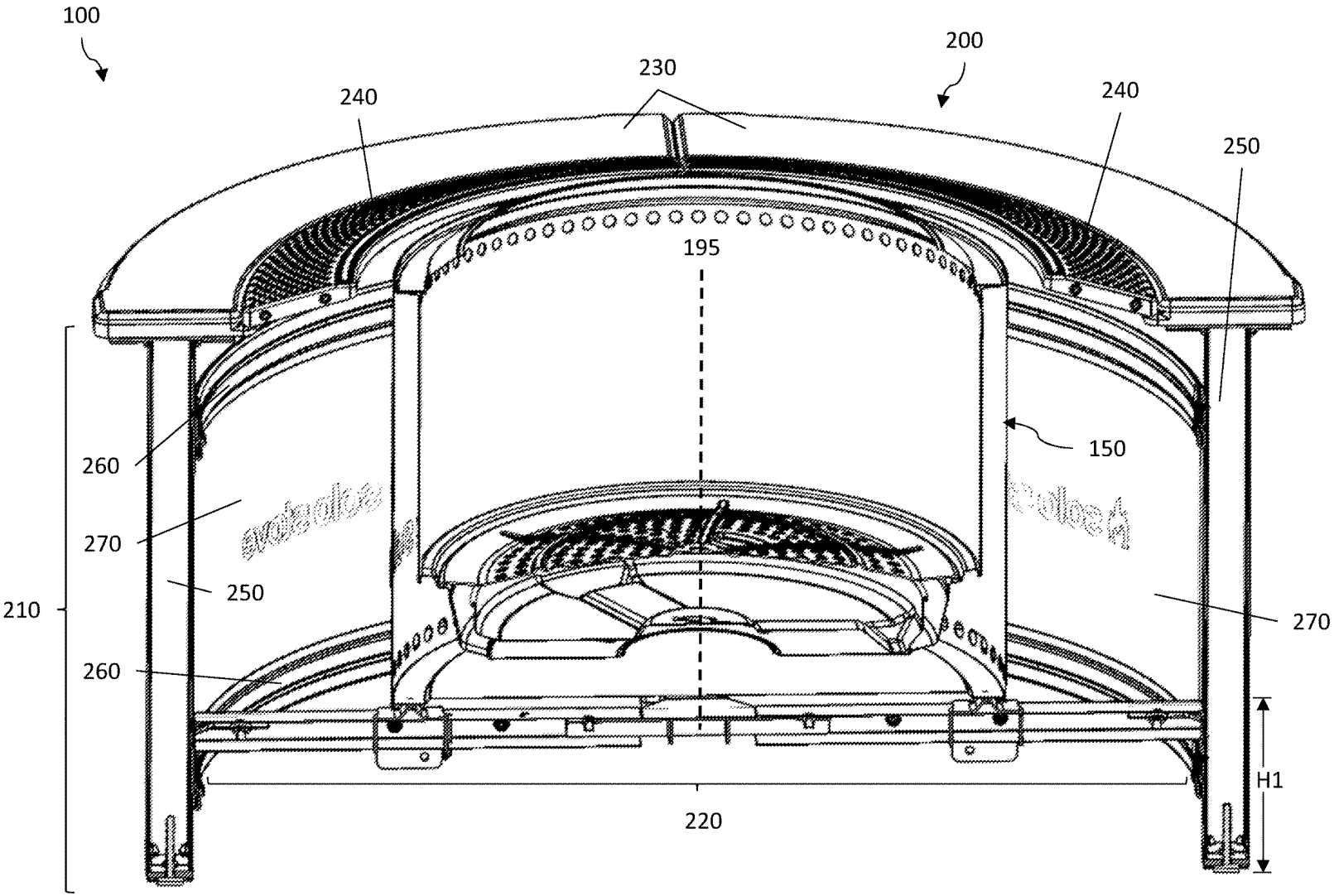
FIG. 3 is a front perspective cross-sectional view of the example fire pit and surround system of FIG. 2, in accordance with at least one embodiment of the present disclosure.

FIGS. 2 and 3 show an example fire pit and surround system 100, in accordance with at least one embodiment of the present disclosure. FIG. 2 shows the fire pit and surround system 100, and FIG. 3 shows the fire pit and surround system in cross-section through the lines 3-3 in FIG. 2. The fire pit and surround system 100 includes a fire pit 150 (e.g., the fire pit 150 of FIG. 1, or a different fire pit) positioned within a fire pit surround 200.

The fire pit surround 200 includes a frame 210, a fire pit support portion 220, tabletop sections 230, and bevel sections 240. The frame 210 can be roughly concentric with and radially surround the fire pit 150. In an example, the frame 210 includes a plurality of support legs 250 and a plurality of support hoops 260. The plurality of leg supports 250 (e.g., two, three, four, five, or more support legs 250) may define the height of the frame 210. The plurality of support hoops 260 (e.g., two three, or more support hoops 260) are removably attached to the support legs 250 at different heights. In this example, the support hoops 260 collectively support a plurality of panels 270 that are removably attached to the support hoops.

The fire pit support portion 220 may support the fire pit 150 and spaces the bottom plate or base plate 170 of the fire pit 150 (see FIG. 1) above ground level by a height H1 (which may for example be selected to minimize the risk of heat damage to the ground, or to another surface).

The plurality of tabletop sections 230 are disposed on top of the frame 210. Spaced radially inward from the tabletop sections 230, the fire pit surround 200 includes the bezel sections 240. In this example, the bezel sections are a plurality of vented bezel sections 240. In some cases, these may be positioned such that the top of the fire pit 150 is at approximately the same height as (e.g., no more than six inches higher or lower than) the radially innermost edges of the bezel sections 240. The bezel sections may for example serve as spacers to prevent the fire pit 150 from coming into contact with the tabletop sections 230 or the panels 270.

In an example, the tabletop sections 230 and ventilated bezel sections 240, may be formed by stamping, folding, and/or drilling one or more sheet metal blanks. Legs 250 may be cut from tube stock (whether circular, square, or otherwise). In the example shown in FIGS. 2 and 3, both the fire pit 150 and the fire pit surround 200 are circular around the central axis 195.

In FIGS. 2 and 3, the surround 200 includes four tabletop sections 230, four bezel sections 240, four support legs 250, two support hoops 260, and four panels 270. The panels 270 are removably attached to, and conform at least approximately to the shape of, the support hoops 260. In the example shown in FIGS. 2 and 3, the support hoops 260, the tabletop formed by the tabletop sections 230, and the bezel formed by the bezel sections 240 are all circular, and at least approximately concentric with the fire pit 150. However, in other embodiments these components may have other shapes, including but bit limited to ovals, squares, rectangles, and polygons (whether regular or otherwise), whether concentric with the fire pit 150 or not, and may either have the same shape or a different shape than the fire pit 150.

The panels may be formed of any suitable material, including flexible or rigid materials. In an example, the panels 270 may be fabric, polymer, non-woven textile, ceramic, composite, metal, or another material or combination of materials. The panels may be vented or non-vented. In some embodiments, the panels 270 may include a heat-resistant material to minimize heat transfer radially outward from the fire pit 150. In other embodiments, the panels 270 may be thin, porous, conductive, or any combination thereof, in order to maximize heat transfer radially outward from the fire pit 150. In one example, the panels 270 may be made of mesh or loose-woven fabric.

The radially outermost edges of the table sections 230 form an outer diameter OD, which creates a perimeter barrier for the fire pit 150. Thus, the fire pit surround can in some instances help reduce the likelihood of users, their pets, or personal items such as shoes, purses, backpacks, etc. coming into undesired contact with the fire pit 150.

In other instances, the fire pit surround 200 provides aesthetic benefits that may improve the appearance of the fire pit 150. For example, the panels 270, tabletop sections 230, bezel sections 240, and other components may be configured in a symmetrical or otherwise visually appealing form, and may be decorated with colors, patterns, images, logos, etc. In still other instances, the fire pit surround may be understood as a functional feature, in that items may be placed on the tabletop sections 230 where they are accessible to people sitting around the fire pit. For example, food, drinks, and other items may be placed on the fire pit. Here, the tabletop sections 230 are spaced from the fire pit 150 by at least the width of the bezel sections 240, and may thus be sufficiently protected from heat transfer that they remain cool enough to touch with bare hands. Conversely, other items such as gloves, coffee mugs, etc. may in some cases be placed on the vented bezel sections 240 in order to keep the items warm, as the bezel sections 240 are substantially closer to the fire pit 150.

In an example, the total height H2 of the fire pit surround 200 may be selected to be slightly less than the height of the fire pit 150 when the fire pit 150 is supported by the fire pit support portion 220 (see FIG. 1), such that top of the fire pit 150 extends slightly above the radially innermost edges of the bezel sections 240, and the bezel sections 240 can therefore restrain the fire pit 150 from moving laterally or radially relative to the fire pit surround 200. However, the surround 200 may accommodate fire pits of different sizes. An inner diameter ID of the fire pit surround 200 is defined by the radially innermost edges of the bezel sections 240, and is selected to be larger than the outer diameter SD of the fire pit 150, such that the fire pit 150 can fit within the fire pit surround 200. Between the radially outermost edge of the fire pit 150 and the radially innermost edge of the bezel sections 240 is a gap 310, whose width is defined as 0.5*(ID−SD). A smaller gap 310 may increase heat transfer between the fire pit 150 and the bezel sections 240. A larger gap 310 may decrease heat transfer between the fire pit 150 and the bezel sections 240.

Figure 4:
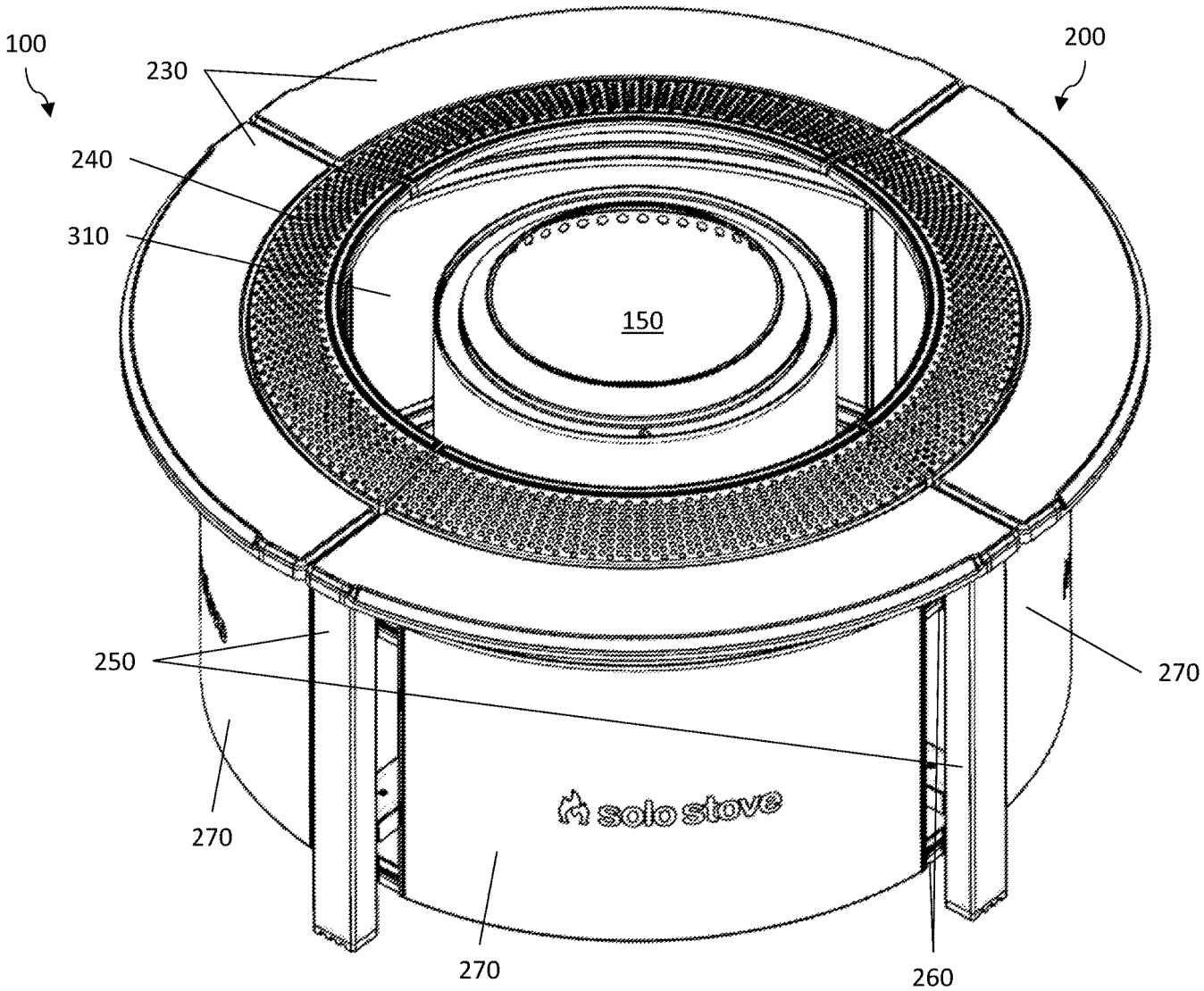
FIG. 4 is a top front perspective view of an example fire pit and surround system, in accordance with at least one embodiment of the present disclosure.

FIG. 4 is a top front perspective view of an example fire pit and surround system 100, in accordance with at least one embodiment of the present disclosure. Visible are the fire pit 150 and fire pit surround 200. The surround 200 includes the tabletop sections 230, bezel sections 240, support legs 250, support hoops 260, and panels 270. The example shown in FIG. 4 is similar to that of FIG. 3, except that the fire pit 150 is smaller, and thus the gap 310 is wider. The fire pit surround 200 may be configured such that it can accommodate fire pits having different diameters, with the gap 310 changing sizes depending on the size of the fire pit.

Figure 5:
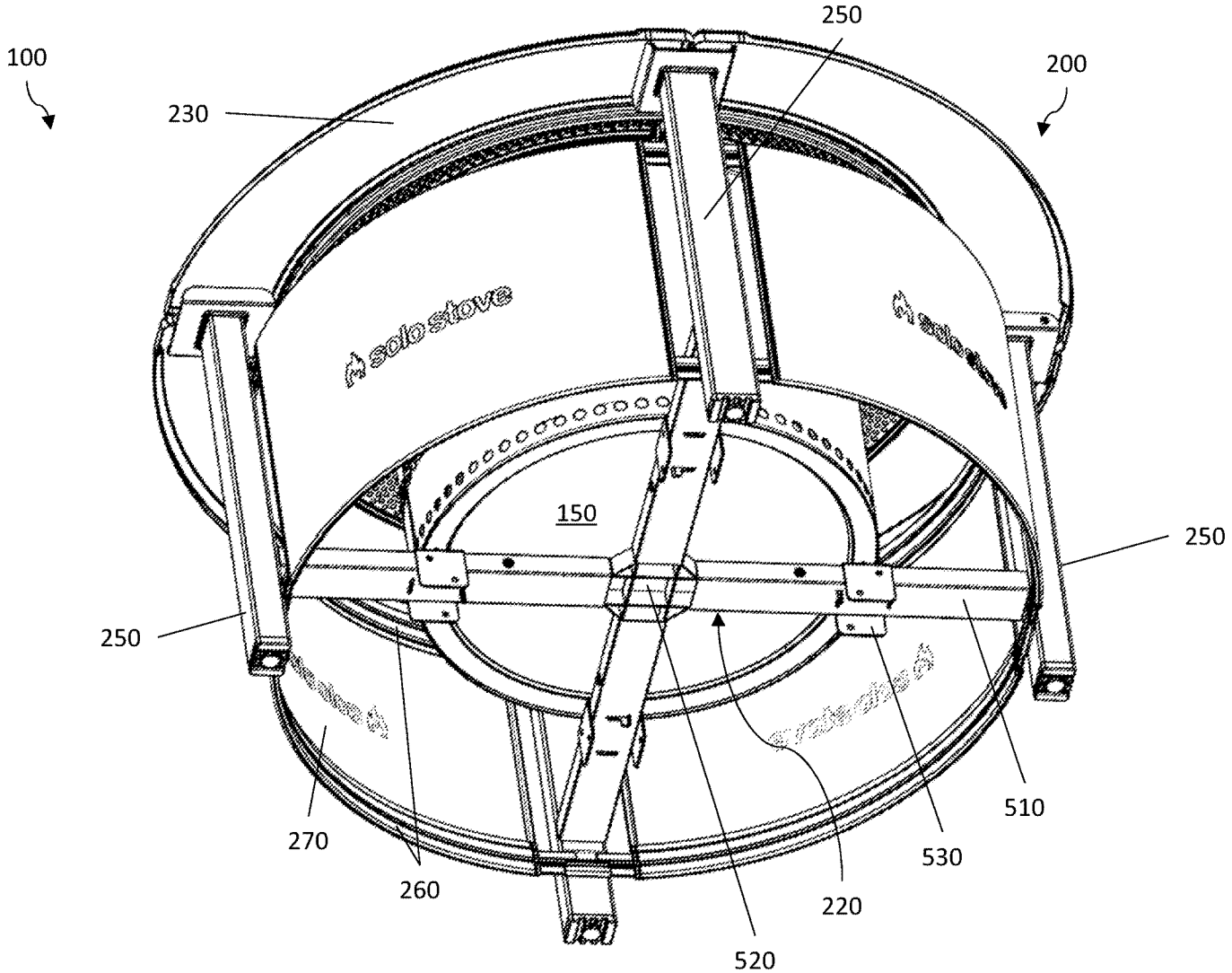
FIG. 5 is a bottom right perspective view of an example fire pit and surround system, in accordance with at least one embodiment of the present disclosure.

FIG. 5 is a bottom perspective view of an example fire pit and surround system 100, in accordance with at least one embodiment of the present disclosure. Visible are the fire pit 150 and fire pit surround 200, including the tabletop sections 230, support legs 250, support hoops 260, and panels 270. Also visible is the fire pit support portion 220 of the fire pit surround 200. The fire pit support portion 220 includes a plurality of support arms 510 (in this example, four support arms 510), with each support arm 510 projecting radially outward from a central intersection 520 to one of the support legs 250. In an example, the support arms 510 are fixedly attached to the support legs 250 (e.g., by welding, brazing, soldering, friction fit, tab-and-slot, co-forming, or other means), although in some embodiments the support arms 510 may be removably attached to the support legs 250 (e.g., by quick-disconnect fasteners, rests, brackets, clips, pins, etc.). In the example shown in FIG. 5, each support arm 510 includes a standoff bracket 530 that may be located in a position to contact the bottom of the fire pit 150. The standoff brackets 530 may be adjustable along the support arms 510 and may be lockable in at least two different positions along the support arm 510, thereby allowing a user to adjust the radial location relative to the central intersection 520. In some implementations, the standoff brackets may be adjusted to interact and secure a fire pit having a particularly sized width. In other implementations, the support arms are used without a standoff bracket to directly support the bottom of the fire pit.

Figure 6:
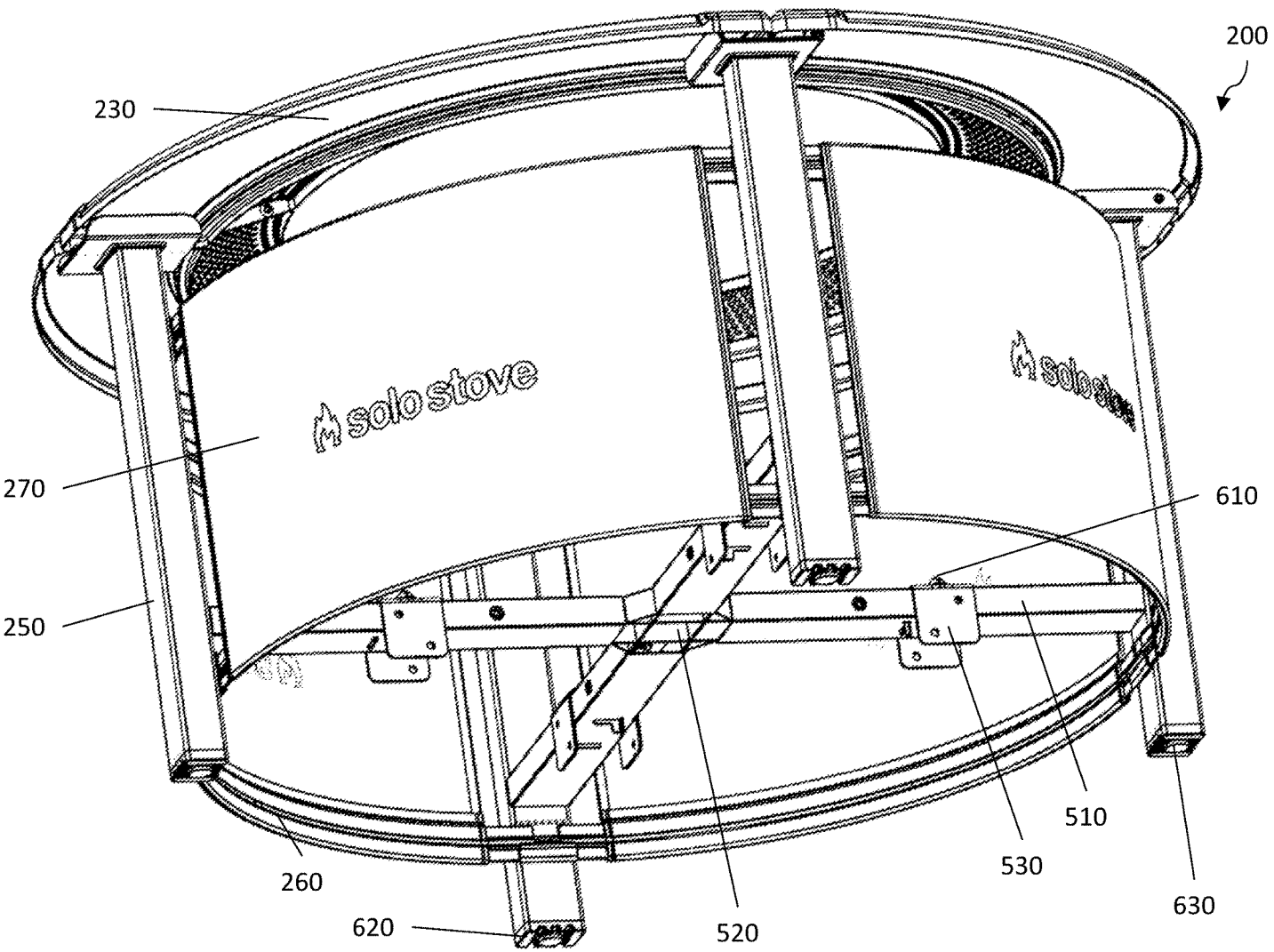
FIG. 6 is a bottom right perspective view of an example surround, in accordance with at least one embodiment of the present disclosure.

FIG. 6 is a bottom perspective view of an example surround 200 without the fire pit. In the example shown in FIG. 6, a top surface of each standoff bracket 530 includes a raised standoff 610, which prevents the fire pit from directly contacting the support arm 510. The standoff is a projection formed in the standoff bracket 530. As indicated with reference to FIG. 4, the standoff bracket 530 may be adjusted along the support arms 510. In some embodiments, the standoff 610 is formed directly as a part of the support arm 510. Some implementations include multiple standoffs formed in each support arm to accommodate placement of fire pits of different sizes.

Also visible are feet 620 at the bottom of each leg 250. In an example, the feet 620 are made of a rubbery material that provides both traction and thermal insulation, thus limiting heat transfer from the leg 250 to the ground or other placement surface. However, in some embodiments, the feet may also include leveling screws 630.

Figure 7:
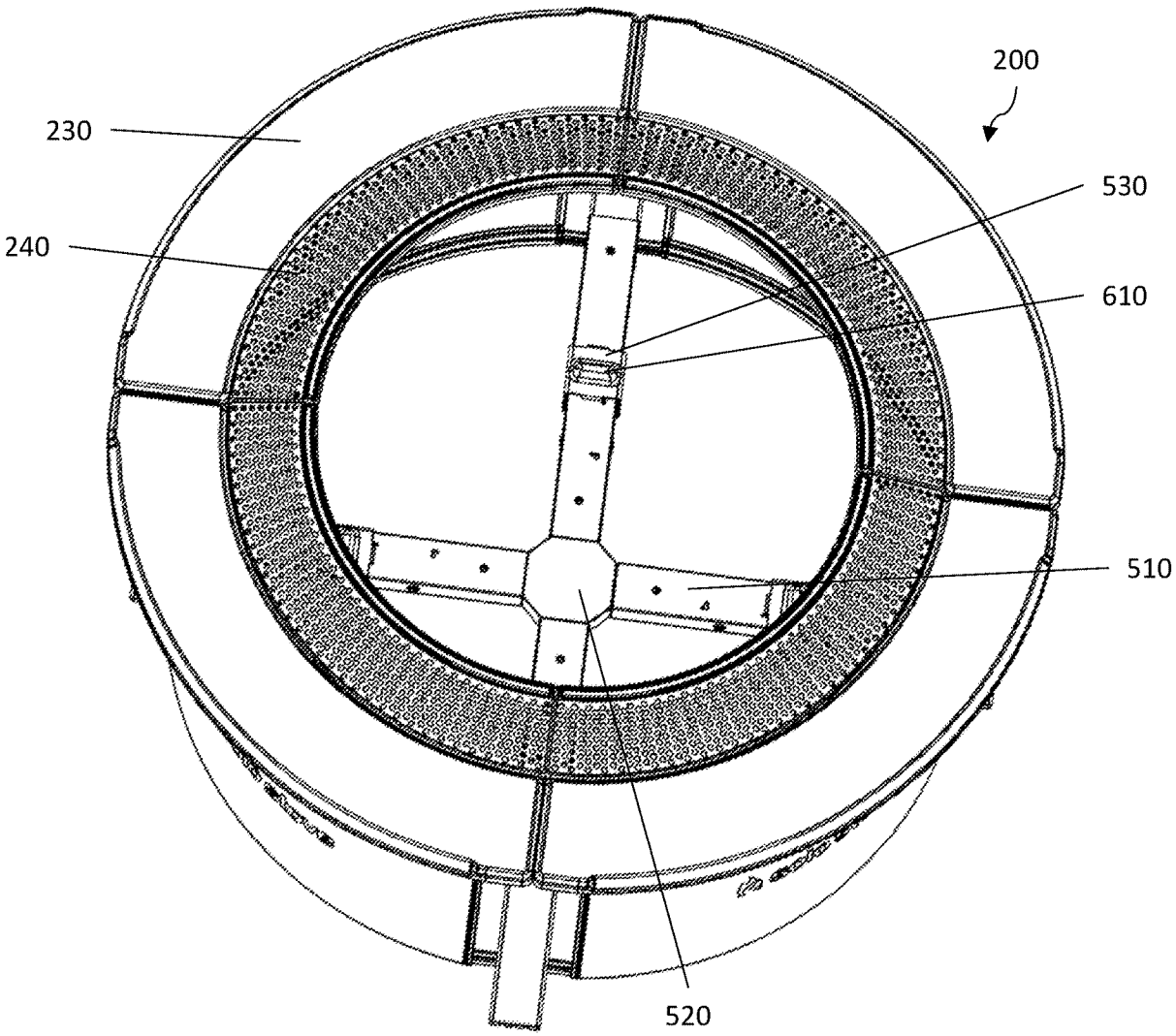
FIG. 7 is a top front perspective view of an example surround, in accordance with at least one embodiment of the present disclosure.

FIG. 7 is a top front perspective view of an example surround in accordance with at least one embodiment of the present disclosure. In the example shown in FIG. 6, a top surface of each standoff bracket 530 includes the raised standoff 610, which prevents the fire pit from directly contacting the support arm 510. In an example, the standoff bracket 530, including the standoff 610, may be formed by stamping, folding, and/or drilling a sheet metal blank.

Figure 8:
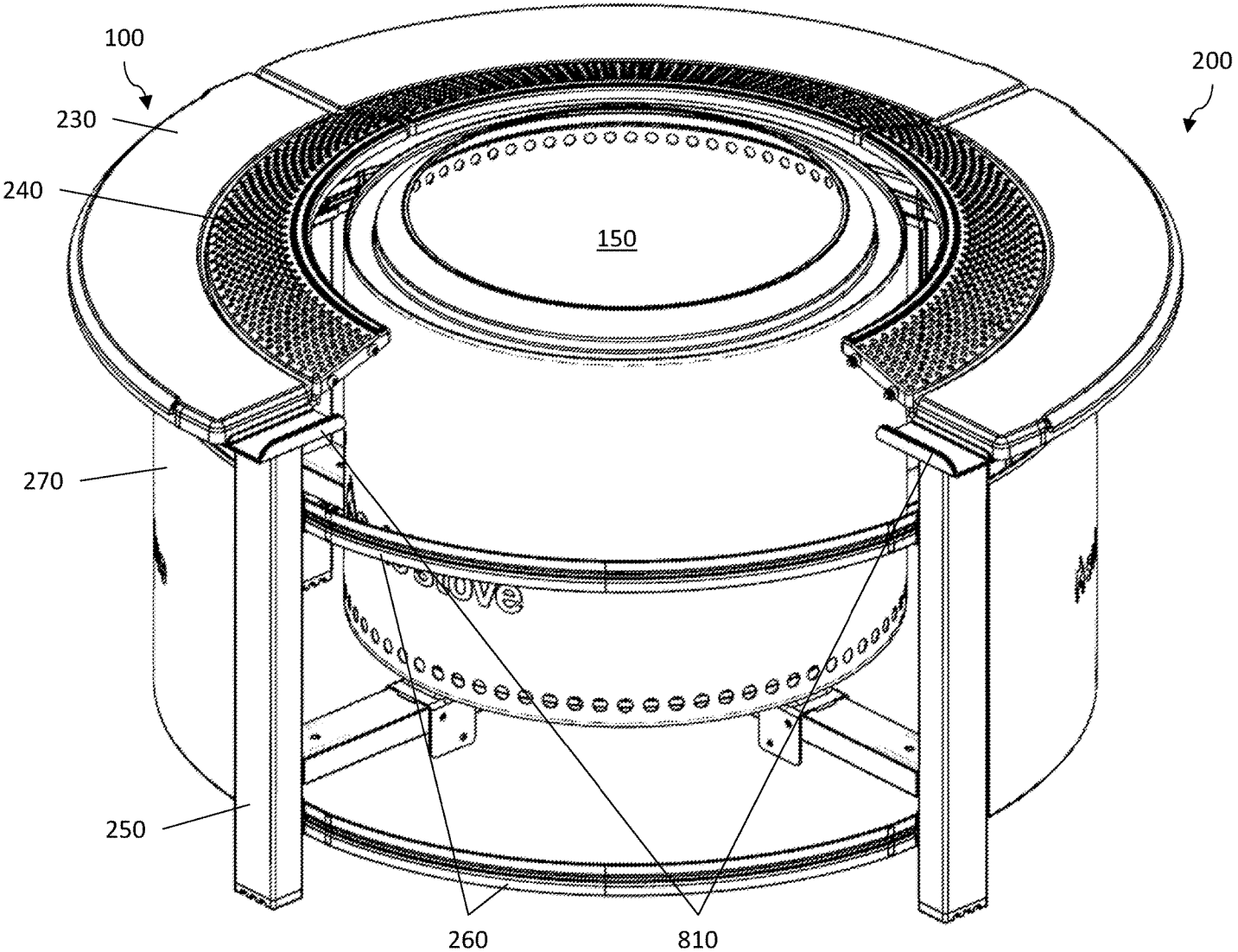
FIG. 8 is a front perspective view of a portion of an example surround system with one panel, one tabletop section, and one bezel section removed for clarity, in accordance with at least one embodiment of the present disclosure.

FIG. 8 is a front perspective view of an example fire pit and surround system 100 with one panel 270, one tabletop section 230, and one bezel section 240 removed for clarity, in accordance with at least one embodiment of the present disclosure. Each leg 250 includes a cradle or connector 810 disposed at an upper end. Each cradle or connector 810 is configured to support a left edge of one tabletop section 230 and a right edge of another adjacent tabletop section 230. Thus, the cradle or connector 810 is sized and shaped to cooperate with two adjacent tabletop sections 230, and is arranged to be disposed directly under an intersection of the two adjacent tabletop sections 230. Accordingly, each tabletop section 230 is supported by two cradles or connectors 810 at its left and right ends respectively.

In an example, the cradles or connectors 810 may be formed by stamping, folding, and/or drilling one or more sheet metal blanks, and may be attached to the legs 250 by welds, solder, brazing, bolts, screws, or other fastening systems or methods.

Figure 9:
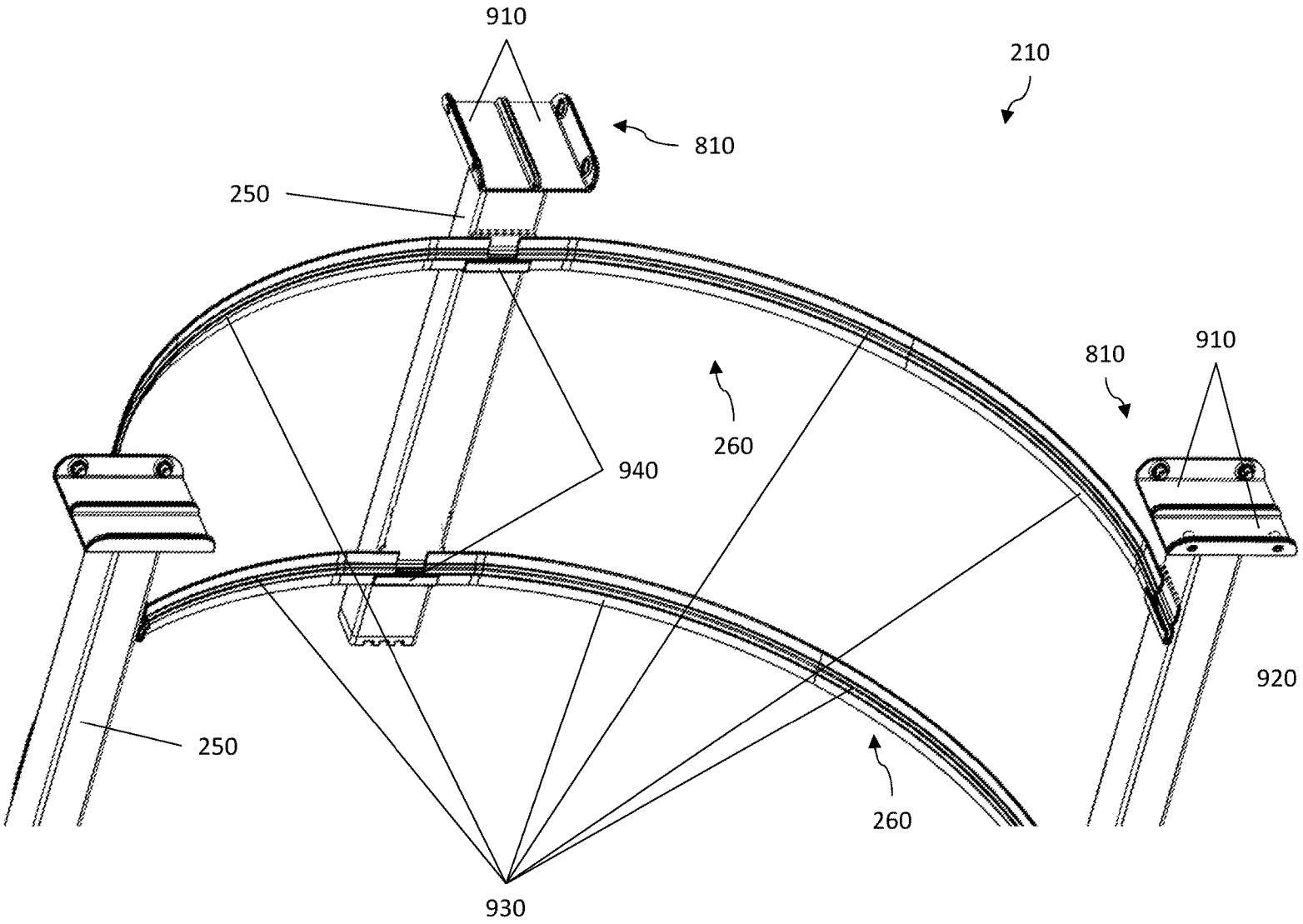
FIG. 9 is a top front perspective view of a portion of an example frame of a surround system, in accordance with at least one embodiment of the present disclosure.

FIG. 9 is a top front perspective view of at least a portion of an example frame 210 of a surround, in accordance with at least one embodiment of the present disclosure. The frame 210 includes legs 250, support hoops 260, and cradles or connectors 810, which provide a lightweight, reconfigurable structure to surround the fire pit. Each cradle or connector 810 includes two pockets 910, and each pocket 910 receives one end of a tabletop section as shown above in FIG. 8. Tabletop sections may rest in the pockets 910 of two cradles or connectors 810 or may be attached with non-threading type connections or other quick disconnect connections.

In the example shown in FIG. 8, each support hoop 260 is made up of four hoop sections 930 that extend from support leg 250 to support leg 250, which attach to the legs 250 via brackets 940, using any combination of gravity, friction, and mechanical tension to keep the hoop sections 930 in place. Here, the brackets 940 are fixed to the legs 250, and an end of each support hoop 260 fits within a slot on the brackets 940. The hoop sections 930 may for example be formed by stamping and/or rolling a sheet metal strip.

Figure 10:
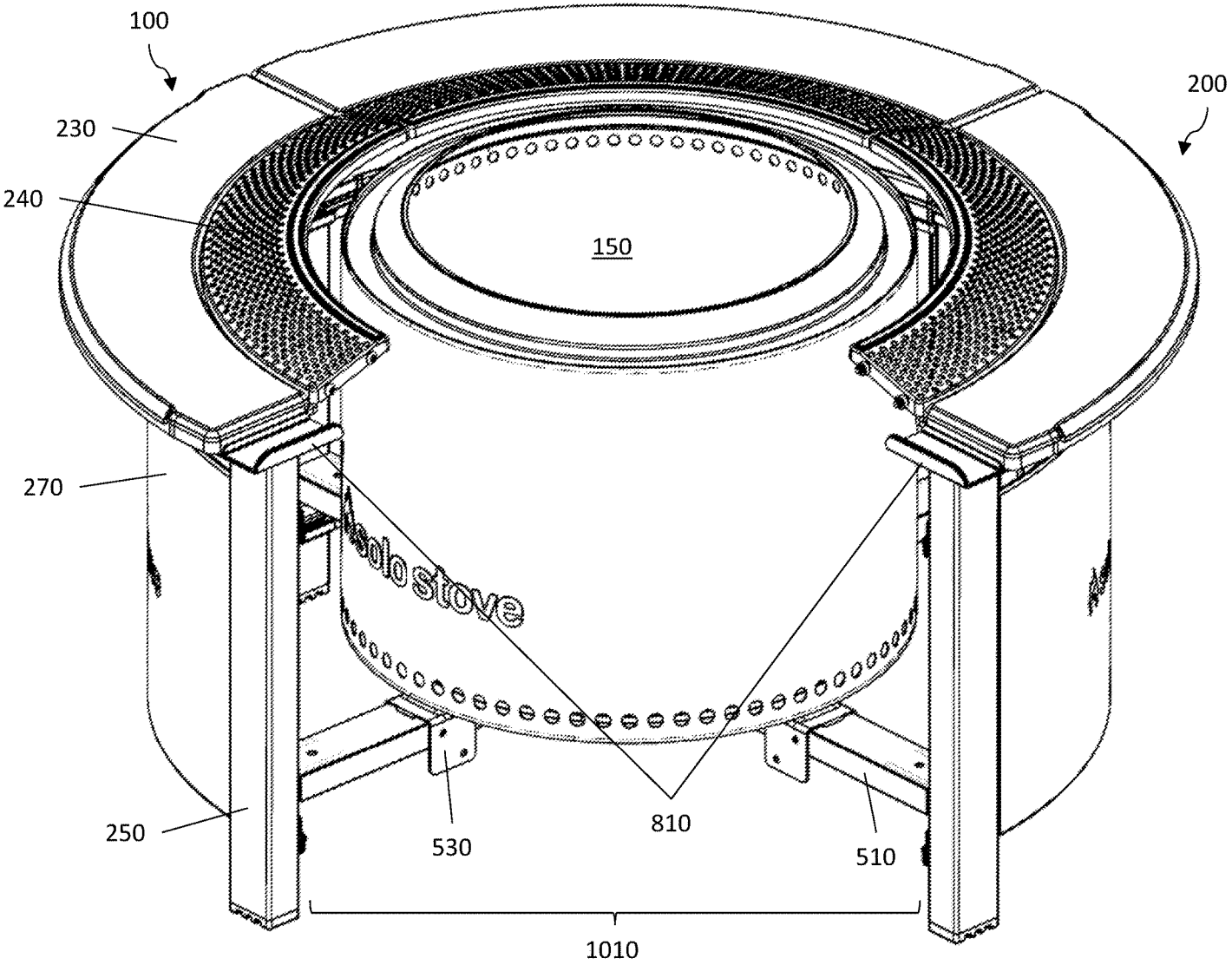
FIG. 10 is a front perspective view of an example fire pit and surround system with one panel, one tabletop section, one bezel section, and two hoop sections removed, in accordance with at least one embodiment of the present disclosure.

FIG. 10 is a front perspective view of an example fire pit and surround system 100 with one panel 270, one tabletop section 230, and one bezel section 240, and two hoop sections 930 removed, in accordance with at least one embodiment of the present disclosure. In this configuration, a radial (e.g., wedge-shaped) section of the fire pit surround 200 has been removed, such that the fire pit surround 200 includes a radial (e.g., wedge-shaped) gap 1010 that allows a user to access the fire pit 150. Such access may for example enable the user to add, rearrange, or ignite fuel inside the fire pit 150. In cases where the fire pit 150 is cool to the touch, such access may enable the user to remove the fire pit 150, or components thereof, from within the fire pit surround 200, for example for cleaning, inspection, or to remove ashes, leaves, or debris.

Figure 11:
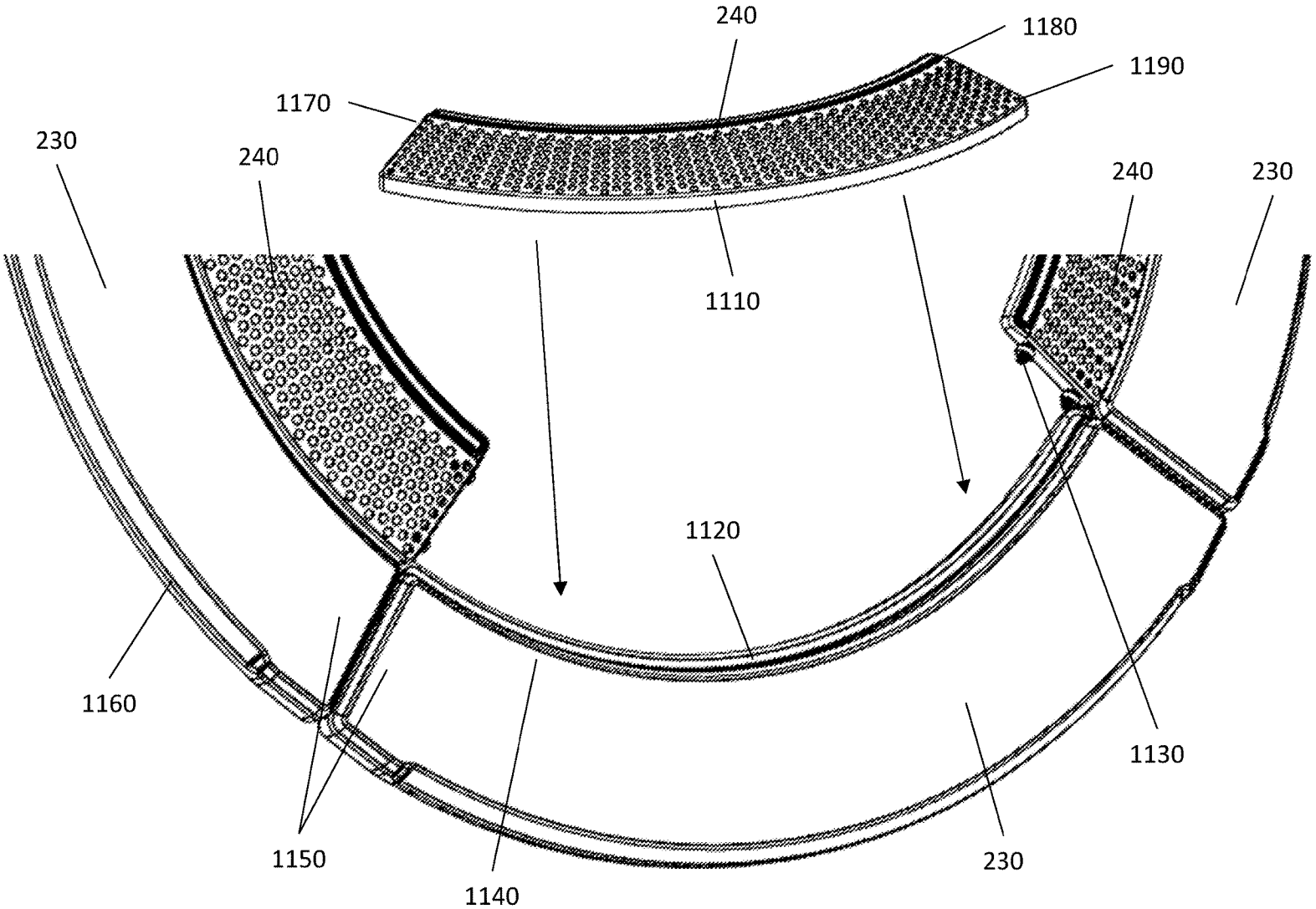
FIG. 11 is a top perspective view of at least some table sections and bezel sections of an example fire pit surround, in accordance with at least one embodiment of the present disclosure.

FIG. 11 is a top perspective view of at least some table sections 230 and bezel sections 240 of an example fire pit surround, in accordance with at least one embodiment of the present disclosure. As seen in FIGS. 2-4, 7-8, and 10, the bezel sections 240 extend radially inward from the table sections 230. FIG. 10 shows an outer lip 1110 on the outer edge 1190 of a bezel section 240, which fits onto an inner shelf 1120 on the inner edge 1140 of a corresponding table section 230. The inner edge 1180 of the bezel section 240 faces inward toward the fire pit, such that the inner edges 1180 of the bezel sections 240 collectively define an inner perimeter of the fire pit surround. A lateral edge 1170 (e.g., a left or right edge) of the bezel section 240 may be removably attached to a lateral edge 1170 (e.g., the other of a left or right edge) of an adjacent bezel section 240 using a fastening system described below. Similarly, the outer edge 1160 of a tabletop section 230 faces outward, away from the fire pit, such that the outer edges 1160 of the plurality of tabletop sections 230 collectively define an outer perimeter of the fire pit. A lateral edge 1150 of a tabletop section 230 may be positioned adjacent to a lateral edge 1150 of a neighboring tabletop section 230.

In some embodiments, the number of bezel sections 240 is equal to the number of table sections 230, and each bezel section 240 fits onto an inner shelf 1120 of a single corresponding table section 230. In other embodiments, the bezel sections 240 may be aligned with the table sections 230 such that each bezel section 240 rests on at least two table sections 230. In some embodiments, a bezel section 240 may be attached to a tabletop section 230 or to another bezel section 240 with a quick-release connector 1130. Quick release connectors may for example include pins, tabs, pegs, clips, brackets, springs, slots, through-holes, captive screws or bolts, or combinations thereof. In this example, the quick release connector is a pin that projects into holes on the lateral ends of the bezel sections 240. The pin may be removed without the use of screws or tools from at least one of the bezel sections so that the bezel section can be easily removed from the rest of the surround.

Figure 12:
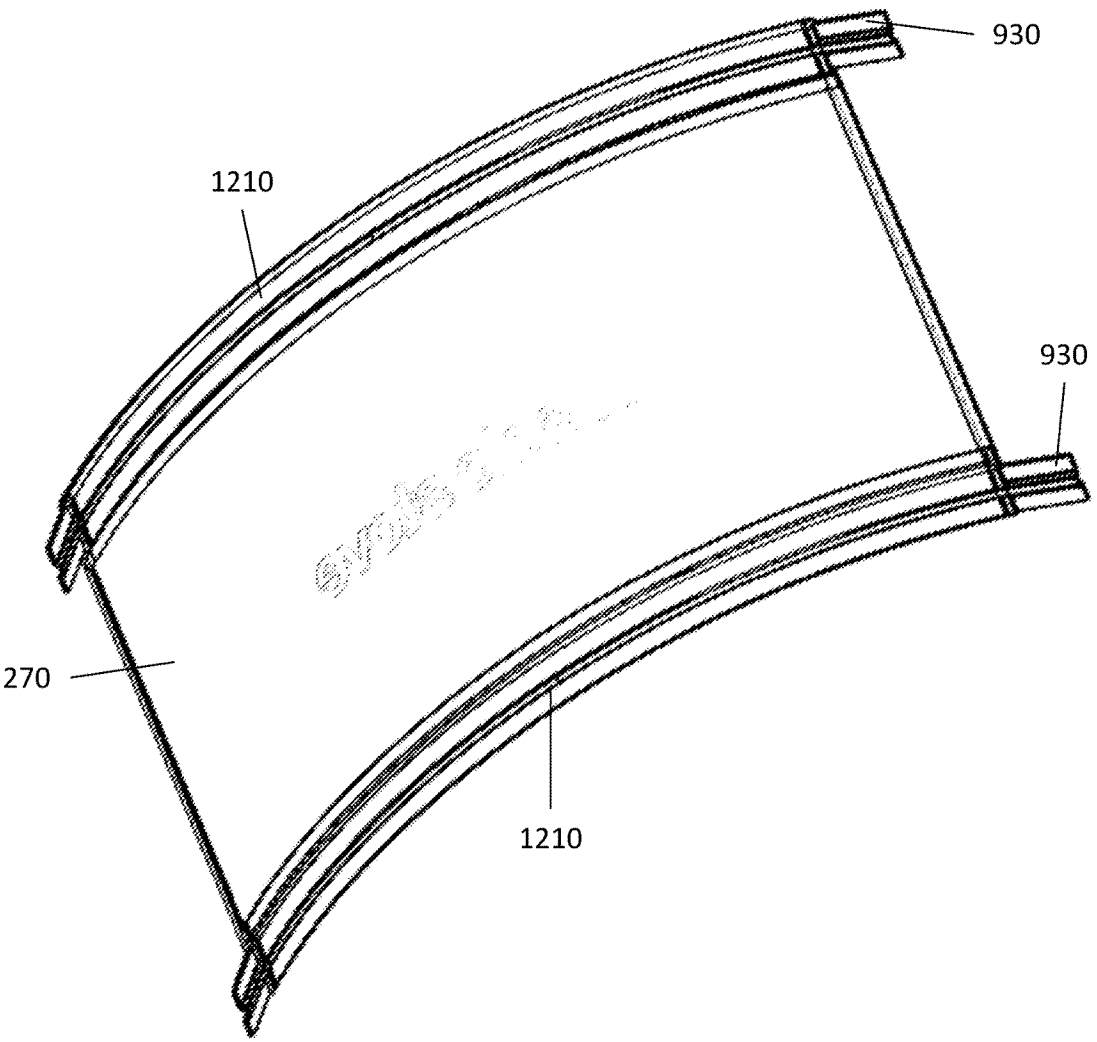
FIG. 12 is a perspective view of a panel mounted on a pair of hoop sections, in accordance with at least one embodiment of the present disclosure.

FIG. 12 is a perspective view of a panel 270 mounted on a pair of hoop sections 930, in accordance with at least one embodiment of the present disclosure. Each hoop section may slide into a sleeve, clip, or bracket 1210 that is configured to receive and retain the hoop section 930, and to hold the panel 270 in the approximate shape of the hoop sections 930 (e.g., a quarter-circle as shown in FIG. 12, or other shapes, depending on the implementation).

Accordingly, it can be seen that the fire pit surround 200 fills a long-standing need in the art, by providing a low-cost, lightweight, reconfigurable structure that surrounds the fire pit 150 as a safety, aesthetic, and/or functional enhancement.

A number of variations are possible on the examples and embodiments described hereinabove. For example, the fire pit surround could be made of heavier-gauge material in order to support more weight, or of lighter gauge material in order to become lighter and more portable. The fire pit surround could be made in different sizes and/or with different degrees of curvature. The relative lengths, widths, and radii of different components could be different than presented herein. The fire pit surround could be made by different processes, including casting, forging, sintering, milling, or 3D printing. It could be made of different materials. The shape could be noncircular, including such possible shapes as ovals, rectangles, triangles, and rhombuses. The technology described herein may be used to burn firewood, wood chips or pellets, scrap lumber, paper, cardboard, coal, and other combustible materials. The surround may also be configured for example to surround lamps, stoves, fire pits, fireplaces, campfires, furnaces, forges, boilers, and other combustion heat sources. In some implementations, the fire pit support portion of the fire pit surround may be removed or deleted, such that the fire pit rests directly on the ground, or on another placement surface. The fire pit surround and its components may include more or fewer sections than shown herein (e.g., two, three, five, or more sections). There may be more or fewer panels, including in some embodiments a single panel fully encircling the fire pit surround.

The logical elements making up the embodiments of the technology described herein are referred to variously as operations, steps, objects, elements, components, or modules. Furthermore, it should be understood that these may occur, or be performed or arranged, in any order, unless explicitly claimed otherwise or a specific order is inherently necessitated by the claim language.

All directional references e.g., upper, lower, inner, outer, upward, downward, left, right, lateral, front, back, top, bottom, above, below, vertical, horizontal, clockwise, counterclockwise, proximal, and distal are only used for identification purposes to aid the reader's understanding of the claimed subject matter, and do not create limitations, particularly as to the position, orientation, or use of the fire pit surround. Connection references, e.g., attached, coupled, connected, and joined are to be construed broadly and may include intermediate members between a collection of elements and relative movement between elements unless otherwise indicated. As such, connection references do not necessarily imply that two elements are directly connected and in fixed relation to each other. The term "or" shall be interpreted to mean "and/or" rather than "exclusive or." Unless otherwise noted in the claims, stated values shall be interpreted as illustrative only and shall not be taken to be limiting.

The above specification, examples and data provide a complete description of the structure and use of exemplary embodiments of the fire pit surround as defined in the claims. Although various embodiments of the claimed subject matter have been described above with a certain degree of particularity, or with reference to one or more individual embodiments, those skilled in the art could make numerous alterations to the disclosed embodiments without departing from the spirit or scope of the claimed subject matter. Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

What is claimed is:

1. A surround for a fire pit, comprising:

a frame comprising:

at least three legs, each leg of the at least three legs comprising a connector disposed at a top portion;

a plurality of tabletop sections, each tabletop section having lateral ends, an inward facing side, and an outward facing side and being configured to connect to the respective connectors of at least two of the legs and also configured to quick disconnect from the connector of said at least two of the legs; and a plurality of bezel sections, each bezel section of the plurality of bezel sections comprising a plurality of ventilation holes and extending radially inward from the inward facing side of a tabletop section of the plurality of tabletop sections, each bezel section having lateral ends, an inner edge, and an outer edge, the inner edge of the plurality of bezel sections defining an inner perimeter of the surround.

2. The surround of claim 1, wherein each bezel section removably extends from least one of the tabletop sections.

3. The surround of claim 1, further comprising a fire pit support comprising a plurality of support arms extending radially inward from the at least three legs to a central intersection.

4. The surround of claim 1, wherein the inner edge of the plurality of bezel sections form an entirely enclosed inner perimeter of the surround.

5. A surround for a fire pit, comprising:

a frame comprising:

at least three legs, each leg of the at least three legs comprising a connector disposed at a top portion;

a plurality of tabletop sections, each tabletop section having lateral ends, an inward facing side, and an outward facing side and being configured to connect to the respective connectors of at least two of the legs and also configured to quick disconnect from the connector of said at least two of the legs;

a plurality of bezel sections, each bezel section of the plurality of bezel sections extending radially inward from the inward facing side of a tabletop section of the plurality of tabletop sections, each bezel section having lateral ends, an inner edge, and an outer edge, the inner edge of the plurality of bezel sections defining an inner perimeter of the surround;

at least two support hoops removably attached to at least two of the legs; and a plurality of vertically oriented panels removably attached to the at least two support hoops and disposed radially outward from the fire pit.

6. The surround of claim 5, wherein at least one tabletop section, at least one bezel section, at least one leg, or at least one panel comprises an added color, pattern, image, or logo.

7. A surround for a fire pit, the surround comprising:

a frame comprising:

at least three legs, each leg of the at least three legs comprising a cradle disposed at a top portion of the leg;

at least two support hoops removably attachable to at least two of the legs;

a panel removably attached to the at least two support hoops;

a plurality of tabletop sections, each tabletop section configured to rest removably in the cradles of at least two of the legs; and a plurality of bezel sections removably connectable to and extending radially inward from the tabletop sections, each bezel section of the plurality of bezel sections comprising an inner edge and an outer edge, the inner edge defining an inner perimeter of the surround.

8. The surround of claim 7, further comprising a fire pit support comprising a plurality of support arms extending radially inward from the at least three legs to a central intersection.

9. The surround of claim 7, wherein each support hoop comprises removable hoop sections, each hoop section comprising part of a circumference of the support hoop.

10. The surround of claim 9, wherein the surround is configured such that a radial section of the surround, defined by a central axis of the surround and two of the legs, can be opened by removing removable hoop sections, the panel, a tabletop section, and a bezel section from within the radial section.

11. The surround of claim 7, wherein at least some of the tabletop sections, at least some of the bezels sections or the panel are held in place by one or more removable fasteners.

12. The surround of claim 7, wherein at least one tabletop section, at least one bezel section, at least one leg, or the panel comprises an added color, pattern, image, or logo.

13. A surround for a fire pit, comprising:

a frame comprising:

at least three legs, each leg of the at least three legs comprising a connector disposed at a top portion;

a fire pit support comprising a plurality of support arms extending radially inward from the at least three legs to a central intersection;

a plurality of tabletop sections, each tabletop section having lateral ends, an inward facing side, and an outward facing side and being configured to connect to the connector of at least two of the legs and also configured to quick disconnect from the connector of said at least two of the legs to provide access to the fire pit support; and a bezel section comprising a plurality of ventilation holes and disposed radially inward from the inward facing side of a tabletop section of the plurality of tabletop sections.

14. The surround of claim 13, further comprising a plurality of bezel sections, each bezel section extending radially inward from the inward facing side of a tabletop section, each bezel section of the plurality of bezel sections having lateral ends, an inner edge, and an outer edge, the inner edge of the plurality of bezel sections defining an inner perimeter of the surround.

15. The surround of claim 14, wherein each bezel section removably extends from least one of the tabletop sections.

16. The surround of claim 14, wherein the inner edge of the plurality of bezel sections form an entirely enclosed inner perimeter of the surround.

17. The surround of claim 14, wherein the frame further comprises:

at least two support hoops removably attached to at least two of the legs; and a plurality of panels removably attached to the at least two support hoops.

18. The surround of claim 17, wherein at least one tabletop section, at least one bezel section, at least one leg, or at least one panel comprises an added color, pattern, image, or logo.

19. The surround of claim 17, wherein each support hoop comprises removable hoop sections, each hoop section comprising part of a circumference of the support hoop.

20. The surround of claim 19, wherein the surround is configured such that a radial section of the surround, defined by a central axis of the surround and two of the legs, can be opened by removing removable hoop sections, a panel, a tabletop section, and a bezel section from within the radial section.

* * * * *